US010020000B2

(12) United States Patent
Najaf-Zadeh et al.

(10) Patent No.: US 10,020,000 B2
(45) Date of Patent: Jul. 10, 2018

(54) METHOD AND APPARATUS FOR IMPROVED AMBISONIC DECODING

(71) Applicant: Samsung Electronics Co., Ltd., Suwon-si, Gyeonggi-do (KR)

(72) Inventors: Hossein Najaf-Zadeh, Allen, TX (US); Yeshwant Muthusamy, Allen, TX (US)

(73) Assignee: Samsung Electronics Co., Ltd., Suwon-Si (KR)

( * ) Notice: Subject to any disclaimer, the term of this patent is extended or adjusted under 35 U.S.C. 154(b) by 171 days.

(21) Appl. No.: 14/589,710

(22) Filed: Jan. 5, 2015

(65) Prior Publication Data

US 2015/0194161 A1 Jul. 9, 2015

Related U.S. Application Data

(60) Provisional application No. 61/923,518, filed on Jan. 3, 2014, provisional application No. 61/923,508, filed (Continued)

(51) Int. Cl.

| | |
|---|---|
| ***G10L 19/00*** | (2013.01) |
| ***G10L 21/00*** | (2013.01) |
| ***G10L 19/02*** | (2013.01) |
| ***G10L 21/0364*** | (2013.01) |
| ***G10L 19/008*** | (2013.01) |

(Continued)

(52) U.S. Cl.

CPC ..... *G10L 19/0212* (2013.01); *G10L 19/008* (2013.01); *G10L 21/0324* (2013.01);

(Continued)

(58) Field of Classification Search

None

See application file for complete search history.

(56) References Cited

U.S. PATENT DOCUMENTS

2008/0040165 A1* 2/2008 Anderson ..... G06Q 40/08 705/4
2008/0154584 A1* 6/2008 Andersen ..... G10L 19/005 704/211

(Continued)

FOREIGN PATENT DOCUMENTS

| | | | |
|---|---|---|---|
| JP | 2013-507796 | A | 3/2013 |
| KR | 10-2012-0070521 | A | 6/2012 |
| WO | WO 2009/067741 | A1 | 6/2009 |

OTHER PUBLICATIONS

International Search Report dated Mar. 31, 2015 in connection with International Patent Application No. PCT/KR2015/000072, 3 pages.

(Continued)

*Primary Examiner* — Kevin Ky

(57) ABSTRACT

An embodiment of this disclosure provides an audio receiver. The audio receiver includes a memory configured to store an audio signal and processing circuitry coupled to the memory. The processing circuitry is configured to receive the audio signal. The audio signal comprises a plurality of ambisonic components. The processing circuitry is also configured to separate the audio signal into a plurality of independent ambisonic subcomponents such that each of the independent ambisonic subcomponents is from a different source. The processing circuitry is also configured to decode each of the independent ambisonic subcomponents. The processing circuitry is also configured to combine each of the decoded independent ambisonic subcomponents into speaker signals.

20 Claims, 8 Drawing Sheets

Related U.S. Application Data on Jan. 3, 2014, provisional application No. 61/923,498, filed on Jan. 3, 2014, provisional application No. 61/923,493, filed on Jan. 3, 2014.

(51) Int. Cl.
*G10L 21/0324* (2013.01)
*G10L 25/18* (2013.01)
*G10L 25/06* (2013.01)

(52) U.S. Cl.
CPC ..... *G10L 21/0364* (2013.01); *G10L 25/06* (2013.01); *G10L 25/18* (2013.01)

(56) References Cited

U.S. PATENT DOCUMENTS

| | | | | |
|---|---|---|---|---|
| 2010/0198601 | A1* | 8/2010 | Mouhssine ..... | G10L 19/008 704/500 |
| 2010/0305952 | A1 | 12/2010 | Mouhssine et al. | |
| 2012/0155653 | A1 | 6/2012 | Jax et al. | |
| 2012/0259442 | A1 | 10/2012 | Jin et al. | |
| 2013/0216070 | A1* | 8/2013 | Keiler ..... | G10L 19/008 381/300 |
| 2014/0149126 | A1* | 5/2014 | Soulodre ..... | G10L 21/0316 704/500 |

OTHER PUBLICATIONS

Written Opinion of International Searching Authority dated Mar. 31, 2015 in connection with International Patent Application No. PCT/KR2015/000072, 6 pages.

Epain, Nicolas, et al., "Independent Component Analysis Using Spherical Microphone Arrays," Acustica United with ACTA Acustica, vol. 98, No. 1, Jan. 1, 2012, pp. 1-16, XP055369478.

Wabnitz, Andrew, et al., "Upscaling Ambisonic Sound Scenes Using Compressed Sensing Techniques," 2011 IEEE Workshop on Applications of Signal Processing to Audio and Acoustics (WASPAA), New Paltz, NY, Oct. 16-19, 2011, pp. 1-4, XP032011510.

Wabnitz, Andrew, et al., "A Frequency-Domain Algorithm to Upscale Ambisonic Sound Scenes," 2012 IEEE International Conference on Acoustics, Speech and Signal Processing (ICASSP 2012), Kyoto, Japan, Mar. 25-30, 2012; IEEE Proceedings, Piscataway, NJ, Mar. 25, 2012, pp. 385-388, XP032227141.

Foreign Communication from a Related Counterpart Application, European Patent Office, "Supplementary European Search Report," Application No. EP 15 73 3320, dated May 15, 2017, 11 pages.

Foreign Communication from a Related Counterpart Application, Korean Intellectual Property Office, "Notification of Reason for Refusal," Application No. KR 10-2016-7021086, dated Jul. 24, 2017, 8 pages.

Wabnitz et al. "A frequency-domain algorithm to upscale ambisonic sound scenes", 2012 IEEE International Conference on Acoustics, Speech and Signal Processing (ICASSP), Mar. 2012, pp. 385-388.

Wabnitz et al., "Time domain reconstruction of spatial sound fields using compressed sensing", 2011 IEEE International Conference on Acoustics, Speech and Signal Processing (ICASSP), May 2011, pp. 465-468.

Wabnitz et al., "Upscaling ambisonic sound scenes using compressed sensing techniques", 2011 IEEE Workshop on Applications of Signal Processing to Audio and Acoustics (WASPAA), Oct. 2011, 4 pages.

* cited by examiner

METHOD AND APPARATUS FOR IMPROVED AMBISONIC DECODING

CROSS-REFERENCE TO RELATED APPLICATION AND CLAIM OF PRIORITY

This application claims priority under 35 U.S.C. § 119(e) to U.S. Provisional Patent Application No. 61/923,518 filed on Jan. 3, 2014, U.S. Provisional Patent Application No. 61/923,508 filed on Jan. 3, 2014, U.S. Provisional Patent Application No. 61/923,498 filed on Jan. 3, 2014, and U.S. Provisional Patent Application No. 61/923,493 filed on Jan. 3, 2014. The above-identified provisional patent application is hereby incorporated by reference in its entirety.

TECHNICAL FIELD

This disclosure relates generally to ambisonic decoding. More specifically, this disclosure relates to improved ambisonic decoding by masking inaudible sounds and using independent component analysis.

BACKGROUND

Ambisonics is an effective technique to encode and reconstruct sound fields. This technique is based on the orthogonal decomposition of a sound field in the spherical coordinates in the 3D space or cylindrical decomposition in the 2D space. In the decoding process, the ambisonic signals are decoded to produce speaker signals. The higher the order of the ambisonics, the finer reconstruction of the sound fields achieved.

Moreover, the complexity of the sound field plays a key role in the quality of the reconstructed sound field for a given ambisonics order. A less complex sound field might be well described by low-order ambisonics whereas a more complex sound field requires Higher-Order Ambisonics (HOA) to be reconstructed with high quality. A complex sound field contains many simultaneous active sources (either localized or distributed sources). If at any time instance (or in a frequency band) there are few active sources, lower order ambisonics would be able to describe and encode the sound field.

SUMMARY

This disclosure provides a method and apparatus for improved ambisonic decoding.

In a first embodiment, this disclosure provides an audio receiver. The audio receiver includes a memory configured to store an audio signal and processing circuitry coupled to the memory. The processing circuitry is configured to receive the audio signal. The audio signal comprises a plurality of ambisonic components. The processing circuitry is also configured to separate the audio signal into a plurality of independent ambisonic subcomponents such that each of the independent ambisonic subcomponents is from a different source. The processing circuitry is also configured to decode each of the independent ambisonic subcomponents. The processing circuitry is also configured to combine each of the decoded independent ambisonic subcomponents into speaker signals.

In a second embodiment, this disclosure provides a method for managing an audio signal. The method includes receiving the audio signal. The audio signal comprises a plurality of ambisonic components. The method also includes separating the audio signal into a plurality of independent ambisonic subcomponents such that each of the independent ambisonic subcomponents is from a different source. The method also includes decoding each of the independent ambisonic subcomponents. The method also includes combining each of the decoded independent ambisonic subcomponents into speaker signals.

In a third embodiment, this disclosure provides a non-transitory computer readable medium embodying a computer program. The computer program includes computer readable program code that, when executed, causes at least one processing device to receive the audio signal. The audio signal comprises a plurality of ambisonic components. The computer program includes computer readable program code that, when executed, also causes at least one processing device to separate the audio signal into a plurality of independent ambisonic subcomponents such that each of the independent ambisonic subcomponents is from a different source. The computer program includes computer readable program code that, when executed, also causes at least one processing device to decode each of the independent ambisonic subcomponents. The computer program includes computer readable program code that, when executed, also causes at least one processing device to combine each of the decoded independent ambisonic subcomponents into speaker signals.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The term "couple" and its derivatives refer to any direct or indirect communication between two or more elements, whether or not those elements are in physical contact with one another. The terms "transmit," "receive," and "communicate," as well as derivatives thereof, encompass both direct and indirect communication. The terms "include" and "comprise," as well as derivatives thereof, mean inclusion without limitation. The term "or" is inclusive, meaning and/or. The phrase "associated with," as well as derivatives thereof, means to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system or part thereof that controls at least one operation. Such a controller may be implemented in hardware or a combination of hardware and software and/or firmware. The functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code"

includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure and its advantages, reference is now made to the following description, taken in conjunction with the accompanying drawings, in which.

DETAILED DESCRIPTION

FIGS. 1 through 8, discussed below, and the various embodiments used to describe the principles of the present invention in this patent document are by way of illustration only and should not be construed in any way to limit the scope of the disclosure. Those skilled in the art will understand that the principles of this disclosure may be implemented in any suitably arranged device or system.

Figure 1:
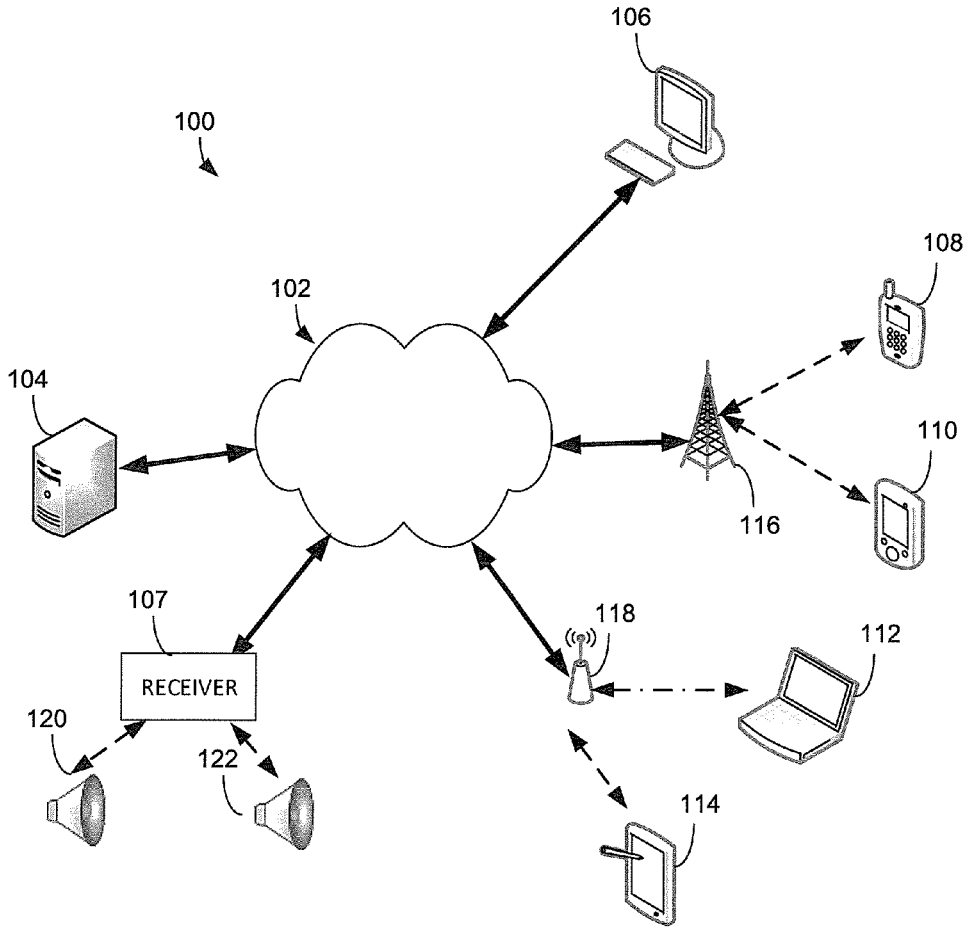
FIG. 1 illustrates an example computing system 100 according to this disclosure.

FIG. 1 illustrates an example computing system 100 according to this disclosure. The embodiment of the computing system 100 shown in FIG. 1 is for illustration only. Other embodiments of the computing system 100 could be used without departing from the scope of this disclosure.

As shown in FIG. 1, the system 100 includes a network 102, which facilitates communication between various components in the system 100. For example, the network 102 may communicate Internet Protocol (IP) packets, frame relay frames, Asynchronous Transfer Mode (ATM) cells, or other information between network addresses. The network 102 may include one or more local area networks (LANs), metropolitan area networks (MANs), wide area networks (WANs), all or a portion of a global network such as the Internet, or any other communication system or systems at one or more locations.

The network 102 facilitates communications between at least one server 104 and various client devices 106-114. Each server 104 includes any suitable computing or processing device that can provide computing services for one or more client devices. Each server 104 could, for example, include one or more processing devices, one or more memories storing instructions and data, and one or more network interfaces facilitating communication over the network 102.

Each client device 106-114 represents any suitable computing or processing device that interacts with at least one server or other computing device(s) over the network 102. In this example, the client devices 106-114 include a desktop computer 106, an audio receiver 107, a mobile telephone or smartphone 108, a personal digital assistant (PDA) 110, a laptop computer 112, and a tablet computer 114. However, any other or additional client devices could be used in the computing system 100.

In this example, some client devices 108-114 communicate indirectly with the network 102. For example, the client devices 108-110 communicate via one or more base stations 116, such as cellular base stations or eNodeBs. Also, the client devices 112-114 communicate via one or more wireless access points 118, such as IEEE 802.11 wireless access points. Note that these are for illustration only and that each client device could communicate directly with the network 102 or indirectly with the network 102 via any suitable intermediate device(s) or network(s).

In this example, audio receiver 107 can receive an audio signal from any one of client devices 106-114. Alternatively, audio receiver 107 can receive an audio signal from the Internet through network 102. Audio receiver 107 can send speaker signals directly to speakers 120 and 122 through a wired network. In another embodiment, audio receiver 107 can send speaker signals indirectly to speakers 120 and 122 through a wireless network.

Although FIG. 1 illustrates one example of a computing system 100, various changes may be made to FIG. 1. For example, the system 100 could include any number of each component in any suitable arrangement. In general, computing and communication systems come in a wide variety of configurations, and FIG. 1 does not limit the scope of this disclosure to any particular configuration. While FIG. 1 illustrates one operational environment in which various features disclosed in this patent document can be used, these features could be used in any other suitable system.

Figure 2:
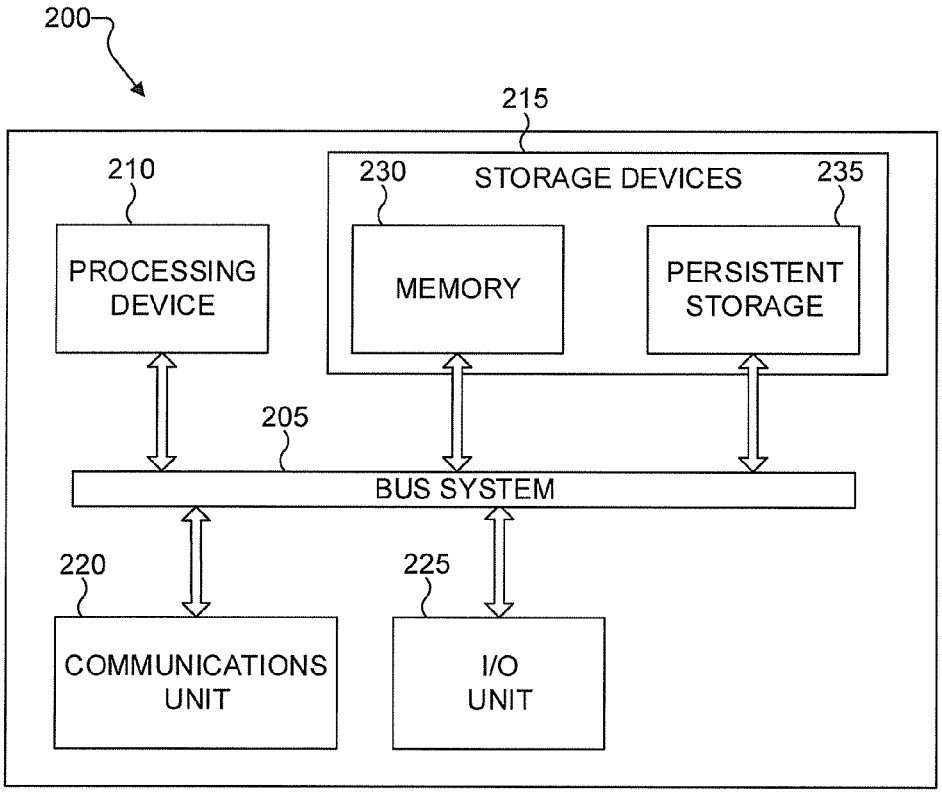
FIGS. 2 and 3 illustrate example devices in a computing system according to this disclosure.
Figure 3:
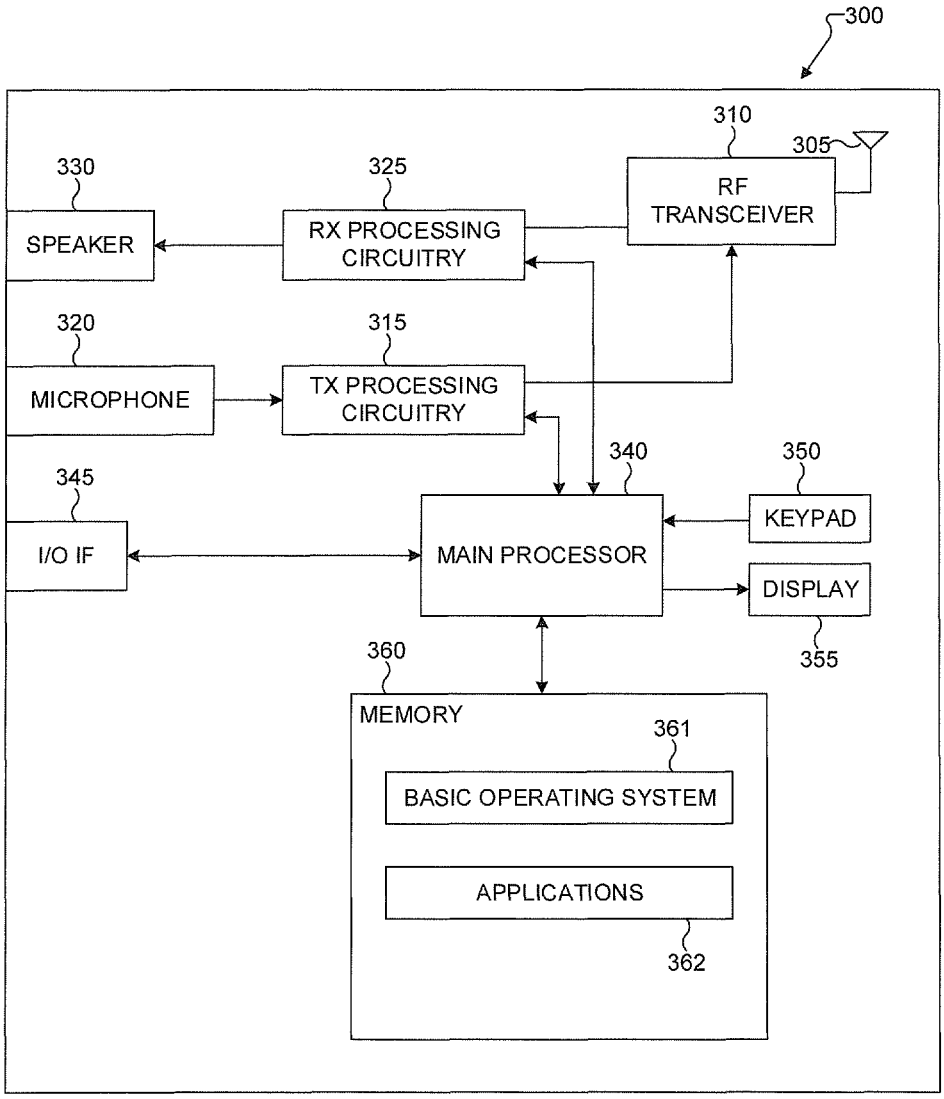

FIGS. 2 and 3 illustrate example devices in a computing system according to this disclosure. In particular, FIG. 2 illustrates an example receiver 200, and FIG. 3 illustrates an example client device 300. The receiver 200 could represent the receiver 107 in FIG. 1, and the client device 300 could represent one or more of the client devices 106-114 in FIG. 1.

As shown in FIG. 2, the receiver 200 includes a bus system 205, which supports communication between at least one processing device 210, at least one storage device 215, at least one communications unit 220, and at least one input/output (I/O) unit 225.

The processing device 210 executes instructions that may be loaded into a memory 230. The processing device 210 may include any suitable number(s) and type(s) of processors or other devices in any suitable arrangement. Example types of processing devices 210 include microprocessors, microcontrollers, digital signal processors, field programmable gate arrays, application specific integrated circuits, and discreet circuitry.

The memory 230 and a persistent storage 235 are examples of storage devices 215, which represent any structure(s) capable of storing and facilitating retrieval of information (such as data, program code, and/or other suitable information on a temporary or permanent basis). The memory 230 may represent a random access memory or any other suitable volatile or non-volatile storage device(s). The persistent storage 235 may contain one or more components or devices supporting longer-term storage of data, such as a ready only memory, hard drive, Flash memory, or optical disc.

The communications unit 220 supports communications with other systems or devices. For example, the communications unit 220 could include a network interface card or a wireless transceiver facilitating communications over the network 102. The communications unit 220 may support communications through any suitable physical or wireless communication link(s).

The I/O unit 225 allows for input and output of data. For example, the I/O unit 225 may provide a connection for user input through a keyboard, mouse, keypad, touchscreen, or other suitable input device. The I/O unit 225 may also send output to a display, printer, or other suitable output device.

Note that while FIG. 2 is described as representing the receiver 107 of FIG. 1, the same or similar structure could be used in one or more of the speakers 120 and 122.

As shown in FIG. 3, the client device 300 includes an antenna 305, a radio frequency (RF) transceiver 310, transmit (TX) processing circuitry 315, a microphone 320, and receive (RX) processing circuitry 325. The client device 300 also includes a speaker 330, a main processor 340, an input/output (I/O) interface (IF) 345, a keypad 350, a display 355, and a memory 360. The memory 360 includes a basic operating system (OS) program 361 and one or more applications 362.

The RF transceiver 310 receives, from the antenna 305, an incoming RF signal transmitted by another component in a system. The RF transceiver 310 down-converts the incoming RF signal to generate an intermediate frequency (IF) or baseband signal. The IF or baseband signal is sent to the RX processing circuitry 325, which generates a processed baseband signal by filtering, decoding, and/or digitizing the baseband or IF signal. The RX processing circuitry 325 transmits the processed baseband signal to the speaker 330 (such as for voice data) or to the main processor 340 for further processing (such as for web browsing data).

The TX processing circuitry 315 receives analog or digital voice data from the microphone 320 or other outgoing baseband data (such as web data, e-mail, or interactive video game data) from the main processor 340. The TX processing circuitry 315 encodes, multiplexes, and/or digitizes the outgoing baseband data to generate a processed baseband or IF signal. The RF transceiver 310 receives the outgoing processed baseband or IF signal from the TX processing circuitry 315 and up-converts the baseband or IF signal to an RF signal that is transmitted via the antenna 305.

The main processor 340 can include one or more processors or other processing devices and execute the basic OS program 361 stored in the memory 360 in order to control the overall operation of the client device 300. For example, the main processor 340 could control the reception of forward channel signals and the transmission of reverse channel signals by the RF transceiver 310, the RX processing circuitry 325, and the TX processing circuitry 315 in accordance with well-known principles. In some embodiments, the main processor 340 includes at least one microprocessor or microcontroller.

The main processor 340 is also capable of executing other processes and programs resident in the memory 360. The main processor 340 can move data into or out of the memory 360 as required by an executing process. In some embodiments, the main processor 340 is configured to execute the applications 362 based on the OS program 361 or in response to signals received from external devices or an operator. The main processor 340 is also coupled to the I/O interface 345, which provides the client device 300 with the ability to connect to other devices such as laptop computers and handheld computers. The I/O interface 345 is the communication path between these accessories and the main processor 340.

The main processor 340 is also coupled to the keypad 350 and the display unit 355. The operator of the client device 300 can use the keypad 350 to enter data into the client device 300. The display 355 may be a liquid crystal display or other display capable of rendering text and/or at least limited graphics, such as from web sites.

The memory 360 is coupled to the main processor 340. Part of the memory 360 could include a random access memory (RAM), and another part of the memory 360 could include a Flash memory or other read-only memory (ROM).

Although FIGS. 2 and 3 illustrate examples of devices in a computing system, various changes may be made to FIGS. 2 and 3. For example, various components in FIGS. 2 and 3 could be combined, further subdivided, or omitted and additional components could be added according to particular needs. As a particular example, the main processor 340 could be divided into multiple processors, such as one or more central processing units (CPUs) and one or more graphics processing units (GPUs). Also, while FIG. 3 illustrates the client device 300 configured as a mobile telephone or smartphone, client devices could be configured to operate as other types of mobile or stationary devices. In addition, as with computing and communication networks, client devices and receivers can come in a wide variety of configurations, and FIGS. 2 and 3 do not limit this disclosure to any particular client device or receiver.

For example, the embodiments disclosed herein, can be implemented with any off-the-shelf speaker. In different embodiments, the speakers can include wired or wireless speaker. The speakers can also include speakers that are included in other devices, such as a television, mobile phone, mobile device and the like. In yet further different embodiments, the speakers can be complex, with their own processors or controllers, or simple, without any complex receivers, processors, or controllers.

Various embodiments of this disclosure recognize and take into account that the spherical harmonic decomposition of a sound field can be fully described by a set of spherical harmonic components (i.e. basis functions in the spherical coordinates). The sound pressure can be expressed as follows:

$$p(kr, \theta, \varphi) = \sum_{m=0}^{\infty} \sum_{n=-m}^{m} W(kr) B_m^n Y_m^n(\theta, \varphi) \tag{1}$$

with k being the wave number, W(kr) being the weighting factor for the rigid sphere, $B_m^n$ being the ambisonic components of the sound field and $Y_m^n(\theta, \varphi)$ being the real-valued spherical harmonic functions in the direction of θ

(azimuth) and φ (elevation). For an order-M ambisonics, the infinity in the above equation is replaced by M and the number of ambisonics components can be $(M+1)^2$ (for 3-D mapping) and (2M+1) (for 2-D mapping).

The main advantage of HOA over other reproduction techniques is its flexibility in using arbitrary speaker configurations to recreate sound fields. The number of speakers required to reproduce the sound field with minimal error can be greater than the number of the ambisonic signals. On the other hand, if the number of playback speakers is much larger than the ambisonics order, the quality of the reconstructed sound field would deteriorate. The reason is that the driving signals for the speakers are found from the ambisonic signals by solving an under-determined linear equation. As such the error in the reconstruction of sound fields would be proportional to the difference between the number of speakers and the number of ambisonic signals. One or more embodiments of this disclosure provide upscale lower-order ambisonics using compressed sensing (CS) techniques and reduce the gap between the number of speakers and the number of ambisonic signals.

CS is a method that allows accurate recovery of signals from sub-Nyquist-rate sampling. If a physical phenomenon (i.e. signal) can be described by a sparse set of basis functions (i.e., mapping onto an over-complete set of basis functions to generate a sparse signal representation), then the number of sensors (i.e. measurements) required to perfectly reconstruct the signal can be much smaller than indicated by the Nyquist theorem. For instance, a time-domain signal resulting from the sum of a few pure tones could be reconstructed perfectly even if the sampling rate is much less than the Nyquist rate. If the representation of a signal is sparse in a certain domain, then it is optimal to measure the signal in a domain whose basis functions are incoherent with the basis functions describing the sparse signal domain. Then the original signal can be recovered through an optimization process based on the L1 norm to find a signal with the smallest L1 norm.

When sampling a signal in any domain, perfect reconstruction of the signal can occur when the sample rate satisfies the Nyquist sampling theorem. According to the CS theory the Nyquist rate is a sufficient condition for the perfect reconstruction of a signal. Under certain assumptions, the observations (i.e., measurements) provided by a sub-Nyquist sampling rate process contains enough information to perfectly describe the observed phenomenon (e.g., signal, sound field, and the like.).

The signal can be described as a sum of a small number of elementary functions (i.e., basis functions in a certain domain). If x denotes the vector of the observations (i.e. measurements) of a sparse vector s, it can then be expressed as follows:

$$x=\Psi s \tag{2}$$

where Ψ is the measurement matrix and s is a sparse vector with many zero coefficients. If K coefficients are non-zero, the signal s is called K-sparse. An example of a sparsity domain is the Fourier domain for sinusoidal time signals. Although a pure tone seems full in the time domain, it is perfectly described by a vector with only one non-zero coefficient in the frequency domain.

According to CS, if a signal is K-sparse in a particular domain, then the number of observations required to describe it perfectly is proportional to K which is less than the Nyquist rate.

Perfect recovery of a signal from a small number of measurements uses equation (2) for s. Since the number of observations (i.e., dimension of x) is small compared to the dimension of s, the system is under-determined and there are an infinite number of solutions. The CS approach to solving this system and resolving the ambiguity is to look for the sparsest solution, which translates into the following optimization process:

$$\min\|s\|_1 \tag{3}$$

subject to x=Ψs. The L1-norm is used to measure the sparsity of vector s instead of the L0-norm (i.e. the non-zero counting norm). An embodiment of this disclosure recognizes and takes into account that, unlike the L1-norm, L0-norm minimization is too complex and almost impossible to solve. The L1-norm minimization leads to a roughly equivalent optimization problem that can be solved by linear programming methods.

One or more embodiments of this disclosure provide an application of compressed sensing to ambisonic decoding. In the ambisonics technique a sound field is mapped onto orthogonal spherical harmonics. This orthogonal projection produces ambisonics signals that will be used to reconstruct the sound field. The decoding of the ambisonics signals is performed in a re-encoding process wherein the unknown speaker signals are encoded to produce the same ambisonic signals as follows:

$$Y_g g(t)=b(t) \tag{4}$$

where g(t) is the vector of speaker signals at time instance t, $Y_g$ is the matrix containing spherical harmonics in the direction of each speaker, and b(t) is the ambisonic signals.

Since the number of the speaker signals is larger than the number of the ambisonic signals, equation (4) has infinite number of solutions. The decoding process involves an optimization procedure to minimize a certain norm of the speaker signals. The classical optimization is based on the L2-norm. A more recent approach to performing the optimization is based on the application of CS to solve equation (4) using the L1-norm (or L12-norm, a combination of L2 and L1 norms to only sparsify the speaker signals in the space).

As stated earlier, the application of compressed sensing requires that the observed phenomenon/signal be sparse in a certain domain. The spherical harmonic domain is not a good candidate in terms of sparsity. There is no reason for the spherical harmonic expansion of a sound field to be sparse unless all of the sound sources are located in very particular directions. On the other hand, if the sound field results from a few sound sources, it is likely to be described by a small number of coefficients in some sparsity domain. When the spherical harmonic expansion is specified up to an order M, the speaker signals can be found to solve equation (4). The classical manner in which this linear problem is solved is to calculate the inverse or pseudo-inverse of $Y_g$. This method provides a unique and exact solution when the system is under-determined; in other words, when the number of speaker signals is greater than the number of ambisonic signals (spherical harmonic components). This solution is referred to as the least square solution as it provides the lowest energy among all of the solutions. The least-square solution tends to distribute the energy evenly among the speakers. This becomes a problem when the number of speakers is greater than the number of spherical harmonic components being used for the expansion of the sound field. In this example, many speakers turn on and driving similar signals leading to spectral distortion that reduces the size of the sweet spot. In this example, one or more embodiments of this disclosure provide a larger sweet spot when a minimal number of speakers are used to recreate a given source. This implies the benefit of using a CS approach to make the speaker signals sparse.

An application of compressive sampling methods is to solve the decoding problem by finding a solution to the following optimization problem:

$$g_{opt}(t)=\text{argmin}\|g(t)\|_{12} \tag{5}$$

subject to $Y_g g(t)=b(t)$, which means searching for the sparsest speaker signals.

The accuracy of a CS-based approach to the upscaling of low-order ambisonics depends on the sparsity level of the sound field, meaning that at any time instance, there should be only few active sound sources in the field. The methods to increase sparsity in sound fields are disclosed in the following embodiments.

One or more embodiments of this disclosure provide upscaling ambisonic signals to higher orders. As mentioned above, ambisonic signals are decoded through a re-encoding process using compressed sensing techniques (i.e., L12 optimization). Once the optimal speaker signals are found, the higher-order ambisonic signals can be obtained as follows:

$$b_{HOA}(t)=Y_{HOA}g_{opt}(t), \tag{6}$$

where $b_{HOA}(t)$ is the upscaled HOA signals and $Y_{HOA}$ is the matrix containing spherical harmonics in the direction of each speaker that includes basis functions up to a desired higher order. For example, in up-scaling from first order to second order ambisonics, each column of $Y_{HOA}$ contains nine spherical harmonics (for 3D mapping).

Another way to upscale ambisonic signals is first to find the de-mixing matrix to decode the lower-order ambisonic signals into the speaker signals as follows:

$$g_{opt}(t)=\tilde{D}_T b(t), \tag{7}$$

where $\tilde{D}_T$ is the smooth decoding matrix. Note that $Y_g\tilde{D}_T=I$, where I is the identity matrix, and $Y_g$ is the matrix containing the spherical harmonics up to the lower order. The upscaling matrix is given by:

$$U=Y_{HOA}\tilde{D}_T \tag{8}$$

and the upscaled ambisonic signals are found as follows:

$$b_{HOA}(t)=U\,b(t) \tag{9}$$

This approach can be used in framed-based ambisonic decoding to upscale the lower-order ambisonic signals locally.

The optimality of the decoded speaker signals contributes to the upscaling process. That is the reason ambisonic decoding is performed using compressed sensing which provides the sparsest optimal speaker signals. If the original sound field is sparse, the optimal decoded speaker signals would accurately represent the original sound field and as such higher order ambisonics can be generated from the optimal speaker signals. This again confirms that the upscaling process based on compressed sensing would be effective on sparse sound fields.

One way to increase the sparsity of sound fields is to decompose the ambisonic signals into many sub-bands to increase the sparsity of the inputs to the CS-based optimization procedure. Another way to increase sparsity of a given sound field is to apply an auditory masking pattern to the ambisonic signals and remove the inaudible parts of the signals. This way, the overlap between the sources in the sound field would be reduced and as such the sparsity of the sound field would be increased. The above-mentioned techniques are discussed in the following sections.

As mentioned above, sparsity of a sound field has a significant impact on the quality of the reconstructed sound field. One or more embodiments of this disclosure provide technique for increasing the sparsity of sound fields (i.e., sub-band decomposition of ambisonic signals and the perceptual sparsity approach). Moreover, the issue of discontinuity of speaker signals is discussed and one or more embodiments of this disclosure provide a new speaker-specific smoothing technique. Also, one or more embodiments of this disclosure provide perception-based techniques to save on the driving power for speaker signals.

Figure 4:
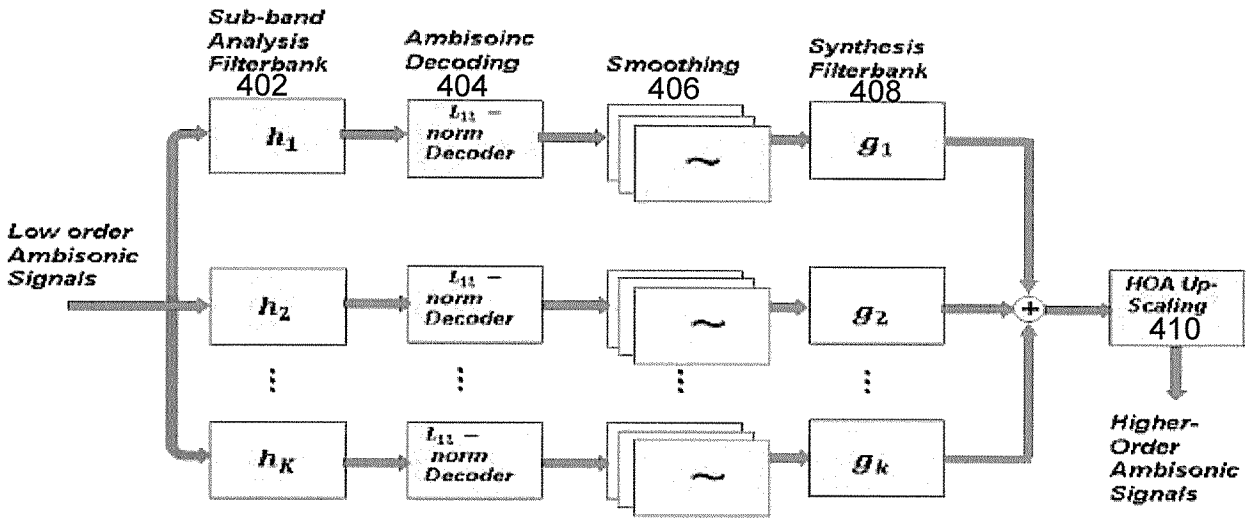
FIG. 4 illustrates a block diagram of a sub-band based ambisonic decoder according to some embodiments of the current disclosure.

FIG. 4 illustrates a block diagram of a sub-band based ambisonic decoder according to some embodiments of the current disclosure. The embodiment of the sub-band based ambisonic decoder illustrated in FIG. 4 is for illustration only. However, sub-band based ambisonic decoders come in a wide variety of configurations, and FIG. 4 does not limit the scope of this disclosure to any particular implementation of a sub-band based ambisonic decoder.

One approach to increasing sparsity of sound fields is to decompose ambisonic signals into subbands. By doing so if the sound sources do not fully overlap in the frequency domain, the subband signals would be sparser than the full-band signals and hence leading to better ambisonic decoding. FIG. 4 shows a block diagram of ambisonic decoding and upscaling based on the subband decomposition of ambisonic signals. In this approach, the ambisonic signals are passed through analysis filterbank 402 followed by the decoding of subband signals 404. The decoded speaker signals are smoothed using speaker-specific smoothing factors 406 and then passed through a synthesis filterbank 408 to generate the full-band speaker signals. The speaker signals are projected to spherical harmonics corresponding to higher-order ambisonic signals 410. The analysis and synthesis filterbanks 402 and 408 form a perfect reconstruction system, with no loss in the quality due to the subband processing of the ambisonic signals.

Figure 5:
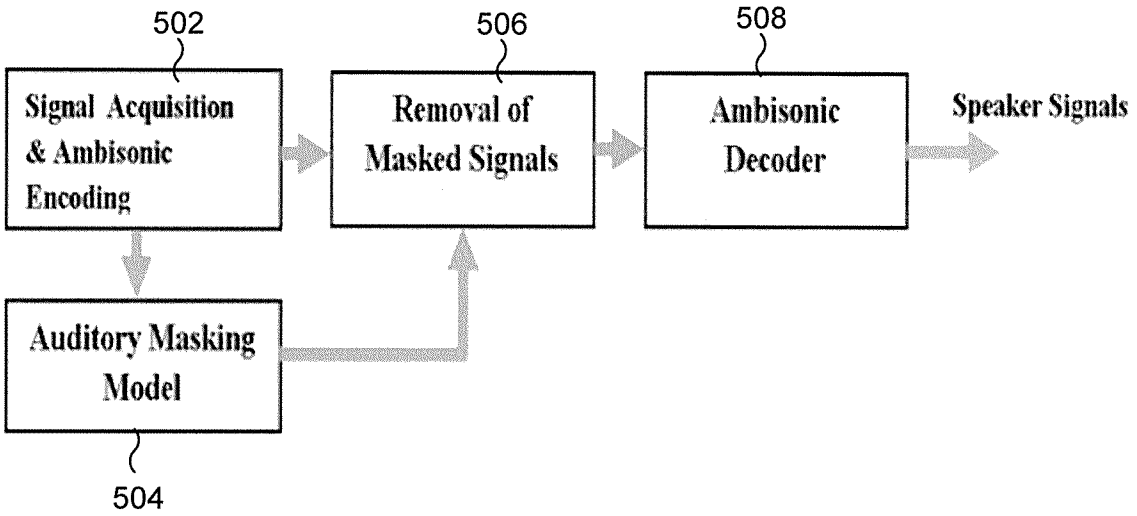
FIG. 5 illustrates a block diagram of an ambisonic decoder using a front-end auditory masking processor according to some embodiments of the current disclosure.

FIG. 5 illustrates a block diagram of an ambisonic decoder using a front-end auditory masking processor according to some embodiments of the current disclosure. The embodiment of the ambisonic decoder illustrated in FIG. 5 is for illustration only. However, ambisonic decoders come in a wide variety of configurations, and FIG. 5 does not limit the scope of this disclosure to any particular implementation of a ambisonic decoder.

In FIG. 5, a controller can control a signal acquisition and ambisonic encoding unit 502, an auditory masking model 504, a process 506 for removal of masked signals, and an ambisonic decoder 508. The encoding unit 502 provides ambisonic signals for masking. The auditory masking model 504 can be one of many different models designed to mask different levels of inaudible parts of the ambisonic components. The process 506 applies the model 504 to the signals from the encoding unit 502 to mask the inaudible parts. The ambisonic decoder maps the masked signals onto the spherical harmonic basis functions to produce the first-order ambisonic signals.

As discussed above, the sparsity of sound fields affects the performance of the CS-based ambisonic decoding. An embodiment of this disclosure provides for perceptual sparsity. Perceptual sparsity can be defined where the human auditory masking effects are exploited to remove any inaudible parts of the ambisonics components. After removal of the inaudible parts, a sparser representation of sound fields will be produced that would lead to more accurate decoding of ambisonic signals. Moreover, the perceptually processed ambisonic signals require a lower bitrate (or memory) for transmission (or storage).

The inaudible parts of the ambisonic signals can be removed as described below:

Each ambisonic signal is split into frames of 30 millisecond (the frame length can also be adapted to the short-term characteristic of the sound field).

$$x_{ij}=x_i((j-1)L+1, \ldots jL)) \tag{10}$$

where $x_{ij}$ is the jth frame of the ith ambisonic signal $x_i$, and L is the frame length.

An auditory masking pattern $\mathcal{M}_{ij}$ for each frame is calculated (any auditory model such as MPEG psychoacoustic model 1 and 2 can be used in this operation).

A global masking pattern $\mathcal{M}_{ijG}(k)$ can be the maximum masking threshold in each frequency bin. Other methods such as linear or nonlinear summation of the masking power in the same frequency bin can be used to find the global masking pattern. An embodiment of this disclosure provides an approach to make sure that no audible part is removed, $$\mathcal{M}_{ijG}(k)=\max\{\mathcal{M}_{ij}(k)\} \tag{11}$$

The ambisonic signals are compared against the global masking pattern in the frequency domain to remove the inaudible parts of the signals (i.e., spectral components below the masking threshold).

$$X_{ij}(k)=\begin{cases} 0 & \text{if } |X_{ij}(k)|^2 < \mathcal{M}_{ijG}(k) \\ X_{ij}(k) & \text{Otherwise} \end{cases} \tag{12}$$

where $X_{ij}$ is the Fourier transform of frame $x_{ij}$.

A sparsity measure in any domain can be the ratio of the number of non-zero samples to the total number of samples. In an example embodiment, up to 60% percent of the spectral components can be removed (i.e., set to zero) that would consequently increase the sparsity of the ambisonic signals and also would save a lot of bandwidth in the transmission of ambisonic signals. FIG. 5 depicts a block diagram of an ambisonic decoder using an auditory masking model 504 as the front-end processor to increase the sparsity of the ambisonic signals in the perceptual domain (i.e. perceptual sparsity).

The following simple example demonstrates the impact of the proposed technique on the accuracy of ambisonic decoding in a sparse sound field where only three active sources are present. In this example, three tonal sources at 1000 Hz, 1020 Hz and 1040 Hz with amplitude of 1, 0.1 and 0.1, respectively, are placed at −150, −60 and 60 degrees, respectively, with reference to the positive direction of the vertical axis. The weaker sources are masked by the strong source and cannot be heard. The sources are mapped onto the spherical harmonic basis functions to produce the first-order ambisonic signals. The ambisonic signals are decoded using norm-L12 to generate the speaker signals. In a first situation, the original ambisonic signals are decoded to produce the speaker signals. In a second situation, an auditory masking pattern is produced from the ambisonic signals and then used to remove inaudible parts of the ambisonic signals. The processed ambisonic signals are decoded to produce the speaker signals. In this example, twelve speakers are located equi-angle around a circle. The presence of the masked parts makes the decoding process less accurate whereas in the second situation the removal of the masked parts highlights the presence of the dominant source and lead to accurate power estimation and perfect localization of that source. In the first situation, the power of the dominant source spreads over a few speakers.

Figure 6:
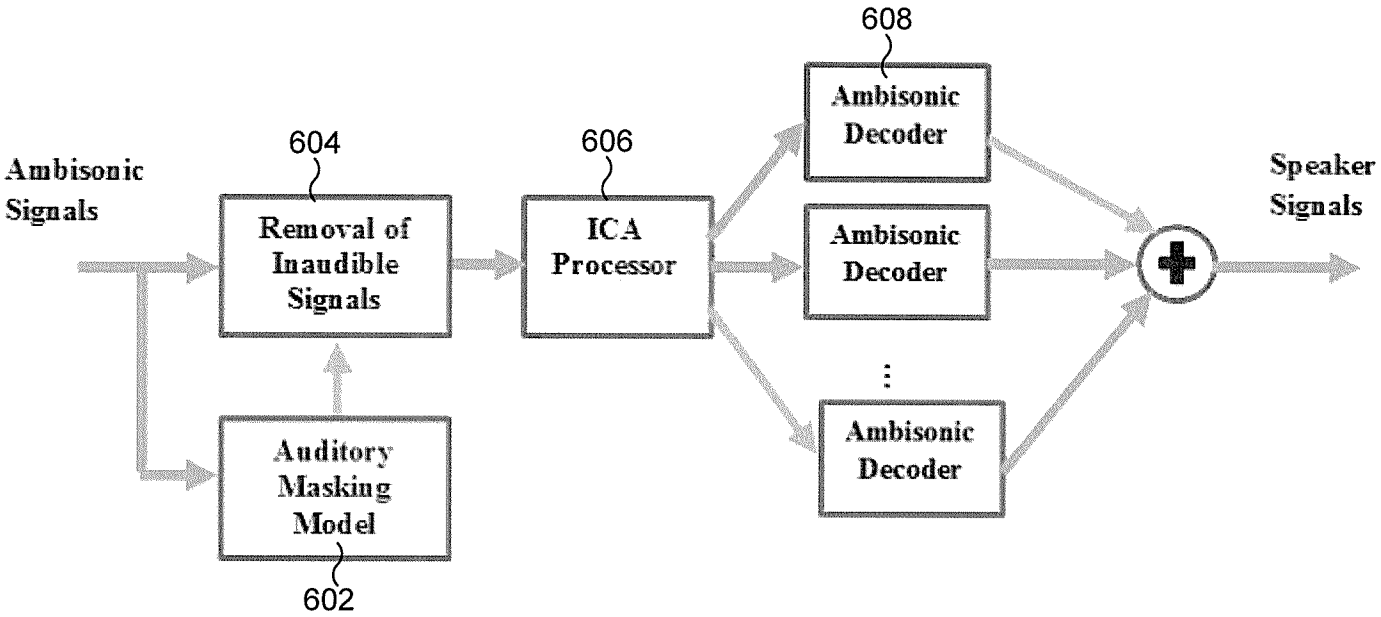
FIG. 6 illustrates a block diagram of an ambisonic decoder using a front-end auditory masking processor and ICA according to some embodiments of the current disclosure.

FIG. 6 illustrates a block diagram of an ambisonic decoder using a front-end auditory masking processor and ICA according to some embodiments of the current disclosure. The embodiment of the ambisonic decoder illustrated in FIG. 6 is for illustration only. However, ambisonic decoders come in a wide variety of configurations, and FIG. 6 does not limit the scope of this disclosure to any particular implementation of an ambisonic decoder.

In FIG. 6, a controller can control an auditory masking model 602, a process 604 for removal of masked signals, an Independent Component Analysis (ICA) processor 606, and ambisonic decoders 608. The auditory masking model 602 can be one of many different models designed to mask different levels of inaudible parts of the ambisonic components. The process 604 applies the model 602 to the signals from an encoding unit to mask the inaudible parts. The ICA processor 606 separates a complex dataset into independent subparts. The ambisonic decoders 608 map the masked signals onto the spherical harmonic basis functions to produce the first-order ambisonic signals.

Independent Component Analysis (ICA) is a statistical technique for decomposing a complex dataset into independent subparts. That technique can provide blind source separation to extract sources from linear mixtures of the sources. ICA is used herein to decompose ambisonic signals into sparser signals. Increasing the sparsity of ambisonic signals improves the accuracy of compressed-sensing-based ambisonic decoding.

In this embodiment, ambisonic signals are linear mixtures of independent sound sources in a given sound field. An embodiment of this disclosure recognizes and takes into account that it can be difficult to estimate the impulse response filters linking each source to each microphone. Depending on the number of sound sources in the sound field and the number of ambisonic signals (i.e. ambisonics order), ICA can be under-, critically-, or over-determined. For example, if there are four sound sources in a given sound field, the first order ambisonics would be critically determined as the number of ambisonic signals equals the number of sound sources. In this example, ICA would extract all the sound sources from the ambisonic signals. For M ambisonic signals and N sources, ICA can output NM signals (N sets of M signals). Each signal set contains the projection of each sound source on the spherical harmonics (i.e., contribution to each microphone recording). As such, one dominant source could exist in each signal set, which is an ideal condition for compressed-sensing-based ambisonic decoding. Each signal set is decoded and mapped on the speakers. The total speaker signals could be the superposition of the decoded speaker signals from each signal set. FIG. 6 shows a block diagram of an ambisonic decoder using ICA as the front-end processor.

Figure 7:
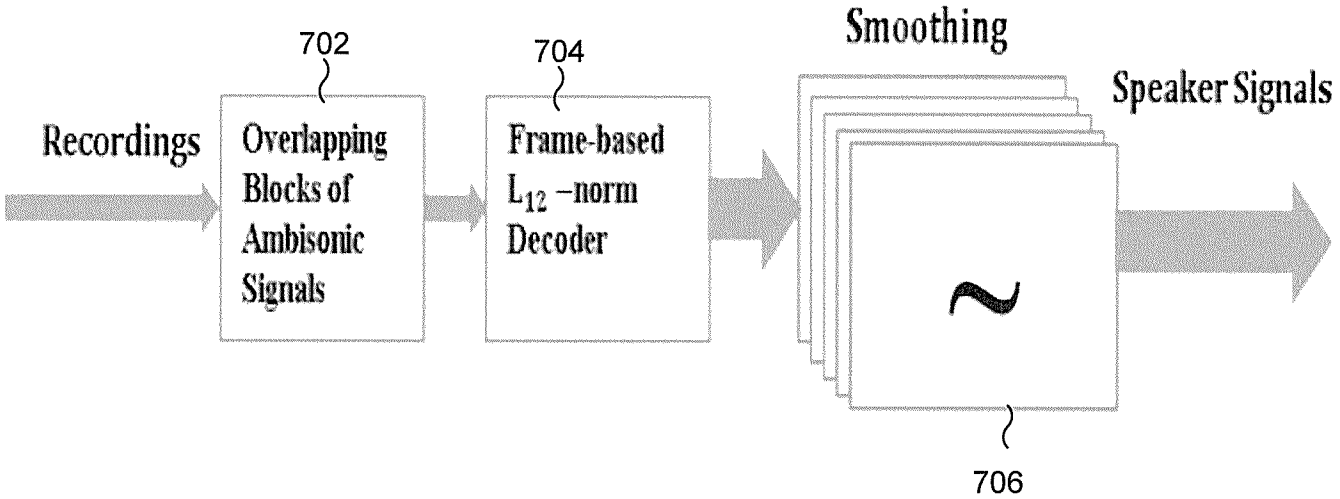
FIG. 7 illustrates a block diagram of an ambisonic decoder using speaker-specific smoothing factors according to some embodiments of the current disclosure.

FIG. 7 illustrates a block diagram of an ambisonic decoder using speaker-specific smoothing factors according to some embodiments of the current disclosure. The embodiment of the ambisonic decoder illustrated in FIG. 7 is for illustration only. However, ambisonic decoders come in a wide variety of configurations, and FIG. 7 does not limit the scope of this disclosure to any particular implementation of an ambisonic decoder.

In FIG. 7, a controller can control a receiving overlapping blocks 702 of ambisonic signals, a frame based L12-norm decoder 704, and smoothing units 706. As described above, ambisonic decoding based on the L2-norm produces the speaker signals with minimum energy. With an L2-norm, energy is distributed over speakers evenly and can deteriorate the localization of sources. Compared to the L2-norm, the L1-norm reconstructs a sound field with higher quality. With the L12-norm, the decoding process is performed locally, where the ambisonic signals are split into frames and the speaker signals are found through the decoding of the frames of the ambisonic signals, adapting the decoding matrix to the local characteristic of the sound field. Local decoding of the ambisonic signals results in some discontinuity in the speaker signals.

One or more embodiments of this disclosure provide two measures to avoid the audible discontinuity in the speaker signals once the frames of the speaker signals are concatenated. The first technique, in order to mitigate the so-called block edge effects in frame-based processing, the frames of ambisonic signals and the speaker signals are windowed and overlapped by 50%. The speaker signals are found through the overlap-add method. Although the overlap-add method would reduce discontinuity in the speaker signals, other measures are warranted to avoid any audible distortion in the decoded signals. As such, one or more embodiments of this disclosure provide a ruled-based method to further prevent any discontinuity at the frames edges and perform a smooth decoding process. Recently a smoothing procedure has been reported wherein a forgetting factor is applied to the decoding matrix to smooth out the decoding process as follows:

$$\tilde{D}_T=(1-\alpha)D_{T-1}+\alpha D_T \tag{13}$$

where $\alpha$ is the forgetting factor, which acts to smooth out any sharp changes in the decoding matrix between time windows, $D_{T-1}$, $D_T$ are the decoding matrix in the previous and current time windows respectively, and $\tilde{D}_T$ is the smooth decoding matrix for the current time window.

In one embodiment of this disclosure, once the decoding matrix is determined, the speaker signals for the Tth time window is obtained from:

$$G_T=\tilde{D}_T B_T \tag{14}$$

The problem with the above-mentioned approach is that the smoothing factor is equally applied to all of the speaker signals that would result in a suboptimal decoding matrix. In an embodiment, the embodiment provides smoothing out the decoding process for each speaker signal separately based on some pre-defined rules as follows:

$$r_i = \beta\frac{\|D_{i,T}\|_2^2}{\|D_T\|_2^2} \tag{15}$$

where $\beta$ is a constant between 1.5 and 2, $D_{i,T}$ is the ith row of the decoding matrix $$\rho_i=\max(corr(D_{i,T},D_{i,T-1}),0) \tag{16}$$

where $\rho_i$ is the correlation between the ith rows in the decoding matrix in the current and previous frames.

A smoothing factor for the ith rows in the decoding matrix (i.e., used to find the ith speaker signal) is defined as follows:

$$\alpha=\min(r_i,\rho_i,0.8) \tag{17}$$

$$\tilde{D}_{i,T}=(1-\alpha)D_{i,T-1}+\alpha D_{i,T} \tag{18}$$

Moreover, the change in the magnitude of each row in the decoding matrix is limited to $$0.5 < \frac{\|\tilde{D}_{i,T}\|}{\|D_{i,T-1}\|} < 2 \tag{19}$$

Ruled-based techniques provide that the smoothing is applied to the necessary extent. In some examples, the decoding vectors (rows in the decoding matrix) in successive frames corresponding to high power speaker signals change smoothly and as such there is no need for further smoothing of those decoding vectors (that would result in less optimal decoding matrix). The slow evolution of the decoding vectors is manifests itself in high correlation of the decoding vectors in successive frames and also larger magnitude of the decoding vector. On the other hand, for the low energy speaker signals, the variation in the decoding vectors (in terms of the magnitude and the correlation of the decoding vectors in successive frames) is large. That observation has motivated us to treat each row in the decoding matrix separately and find and apply different smoothing factors to the decoding vectors (i.e., rows in the decoding matrix). Compared to reported method in the audio community where a single smoothing factor is used to smooth out the decoding matrix, the embodiments disclosed herein are more accurate and performs more optimal ambisonic decoding.

In another embodiment of this disclosure, a single smoothing factor $\alpha$ is determined based on the correlation between the current and previous frames of speaker signals. Due to a 50% overlap between the current and previous frames, the correlation of the overlapping segments of the current and previous frames is calculated as follows, $$\rho_m = corr\left\{Sp\left(m, 1:\frac{L}{2}\right), SpOld\left(m, \frac{L}{2}+1:L\right)\right\} \tag{20}$$

where Sp and SpOld are the speaker signals in the current and previous frames, and $\rho_m$ is the correlation between the overlapping parts of speaker signal m in the current and previous frames (i.e. first half of the current frame and second half of the previous frame). The smoothing factor is calculated as follows, $$\alpha=\max\{\rho_m\} \tag{21}$$

$$\tilde{D}_T=\alpha\tilde{D}_{T-1}+(1-\alpha)D_T$$

In this example embodiment, the smoothing factor $\alpha$ is used differently than in the above embodiments. If the overlapping parts of the speaker signals are highly correlated, the previous decoding matrix can be used; otherwise the decoding matrix will be a linear combination of the decoding matrices for the current and previous frames. This embodiment provides no discontinuity in the speaker signals.

An embodiment provides power savings in ambisonics decoding. In the ambisonics technique a sound field is mapped onto orthogonal spherical harmonics. This orthogonal projection produces ambisonics signals that will be used to reconstruct the sound field. The decoding of the ambisonics signals is performed in a re-encoding process wherein the unknown speaker signals are encoded to produce the same ambisonics signals.

The decoding process involves an optimization procedure to minimize a certain norm of the speaker signals. The classical optimization is based on the L2-norm which produces the speaker signals with minimum energy. However, the drawback of this norm is that it would distribute the energy over speakers somehow evenly and as such would deteriorate the localization of sources. An approach to performing the optimization is based on the L0-norm (or L12-norm, a combination of L2 and L1 norms to only sparsify the speaker signals in the space). Compared to the L2-norm, L1-norm would reconstruct a sound field with higher quality at the cost of larger power of the speaker signals. An embodiment of this disclosure provides a method based on the human auditory making effects to reduce the power of the speaker signals while using the L12-norm to reconstruct sound fields with high quality.

The optimization procedure based on the L12-norm is performed as follows:

$$g_{opt}(t)=\text{argmin}\|g(t)\|_{12} \tag{22}$$

subject to:

$$Y_g g(t)=b(t) \tag{23}$$

where $g_{opt}(t)$ is the vector of speaker signals at time instance t, $Y_g$ is the matrix containing spherical harmonics in the direction of each speaker, and b(t) is the ambisonic signals.

An embodiment of this disclosure provides three approaches to modify the speaker signals in order to reduce the driving power.

In the first approach, the argument in the optimization (i.e. g(t)) is compared against an auditory masking pattern produced by the speaker signals and only the audible parts are kept and the inaudible parts are discarded. This approach will produce only audible signals and all of the resulting speaker signals will contribute to the reconstruction of the sound field. In other words, the argument of the above optimization is replaced by $\tilde{g}(t)$ that contains only the audible parts of g(t). Since at each step in the optimization masking patterns for each speaker signal needs to be calculated, one or more embodiments of this disclosure provide an approach where in the equality constrain in the optimization procedure is replaced by an inequality constrain.

In the above optimization, the speaker signals produce the same ambisonic signals once mapped onto the spherical harmonic basis function. However, from a perceptual point of view, that requirement is too strict and is not necessary to be satisfied. As such, an embodiment of this disclosure modifies the optimization process to find the speaker signals with their projection onto the spherical harmonic basis function approximating the original ambisonic signals. The difference between the projection of the speaker signals and the original ambisonic signals may not be audible. As such, the difference between $Y_g g(t)$ and b(t) can be less than the auditory masking pattern induced by the original ambisonic signals. The optimization procedure is modified as follows:

$$g_{opt}(t)=\text{argmin}\|g(t)\|_{12} \tag{24}$$

subject to $$\|Y_g g(t)-b(t)\|_2 \leq \mathcal{M}_b(t) \tag{25}$$

where $\mathcal{M}_b(t)$ is the masking pattern generated by the ambisonic signals. If the masking pattern is calculated in the frequency domain (i.e., simultaneous masking effects), the optimization will be performed in the frequency domain by transforming the ambisonic signals to the frequency domain and then solve the above optimization to find the Fourier transform of the speaker signals. The speaker signals in the time domain will be the inverse Fourier transform of the speaker signals spectra.

An embodiment of this disclosure provides a second approach without modifying the optimization procedure. In this approach, once the resulting speaker signals are found, an auditory masking pattern induced by the speaker signals is determined. Then all the speaker signals are compared against the masking pattern and only the audible parts are kept.

The procedure of removing the inaudible parts of the speaker signals is described below:

Each speaker signal is split into frames of 30 msec (the frame length can be adapted to the short-term characteristic of the sound field).

$$s_{ij}=s_i((j-1)L+1, \ldots, jL)) \tag{26}$$

where $s_{ij}$ is the jth frame of the ith speaker signal $s_i$, and L is the frame length.

An auditory masking pattern $\mathcal{M}_{ij}$ for each frame is calculated (any auditory model such as MPEG psychoacoustic model 1 and 2 can be used in this step).

A global masking pattern $\mathcal{M}_{ijG}$ (k) is found as the maximum masking threshold in each frequency bin. Other methods such as linear or nonlinear summation of the masking power in the same frequency bin can be used to find the global masking pattern. In an example embodiment, the approach can be less aggressive to reduce the chances that an audible part is removed.

$$\mathcal{M}_{ijG}(k)=\max\{\mathcal{M}_{ij}(k)\} \tag{27}$$

The speaker signals are compared against the global masking pattern in the frequency domain to remove the inaudible parts of the signals (i.e., spectral components below the masking threshold).

$$S_{ij}(k)=\begin{cases} 0 & \text{if } |S_{ij}(k)|^2 < \mathcal{M}_{ijG}(k) \\ S_{ij}(k) & \text{Otherwise} \end{cases} \tag{28}$$

where $S_{ij}$ is the Fourier transform of frame $s_{ij}$.

The perceptually processed frames are windowed and overlapped by 50% to avoid any discontinuity in the speaker signals due to the independent processing of the frames. This proposed method can reduce the driving power up to 10% (depending on the sound field).

In this disclosure, one or more embodiments provide compressed sensing techniques for upscaling HOA sound fields to higher orders. Upscaled sound fields have a greater spatial resolution, which allows more speakers to be used during the playback, resulting in a larger sweet spot and improved sound quality. A number of embodiments, including perceptual sparsity, speaker-specific smoothing of speaker signals and perception-based power saving are introduced to improve ambisonic decoding.

HOA upscaling based on compressed sensing techniques allows reproducing sound fields similar to those reconstructed from original HOA. The effectiveness of ambisonic decoding based on compressed sensing depends on the instantaneous sparsity of the sound field (i.e. a few active sound sources in the sound field), one can exploit the short term sparsity of the sound field in the CS-based approach to enhance the ambisonic decoding as opposed to classical ambisonics decoding based on the least-norm.

Once a sound field accurately is reconstructed using the CS approach, the ambisonic components can be upscaled to a higher order ambisonics. However, the success of the upscaling technique is affected by the complexity of a given sound field. If a few sound sources are located in a small subspace (e.g. 2D surface), the upscaled ambisonics is a good replica of the original ambisonics. Otherwise, the quality of sound fields reconstructed from upscaled ambisonics would likely degrade. For instance, upscaling a first-order ambisonis to second order in 2D space requires estimating two missing ambisonic signals whereas in a 3D space that would be five signals. Moreover, the CS-based HOA upscaling is effective if the original sound field is sparse (i.e. a small number of sources are active at any time instance.).

Another issue is that the CS measurement matrix (the spherical harmonics) can be incoherent to reduce the error of a signal with higher dimension (e.g. speaker signals). In other words, a matrix with random components would be a good choice for sensing a higher dimensional signal. That constrain is not satisfied since a given sound field is not sampled randomly (i.e., random intervals and random directions) and as such spherical harmonics would limit the effectiveness of the CS-based HOA method.

Figure 8:
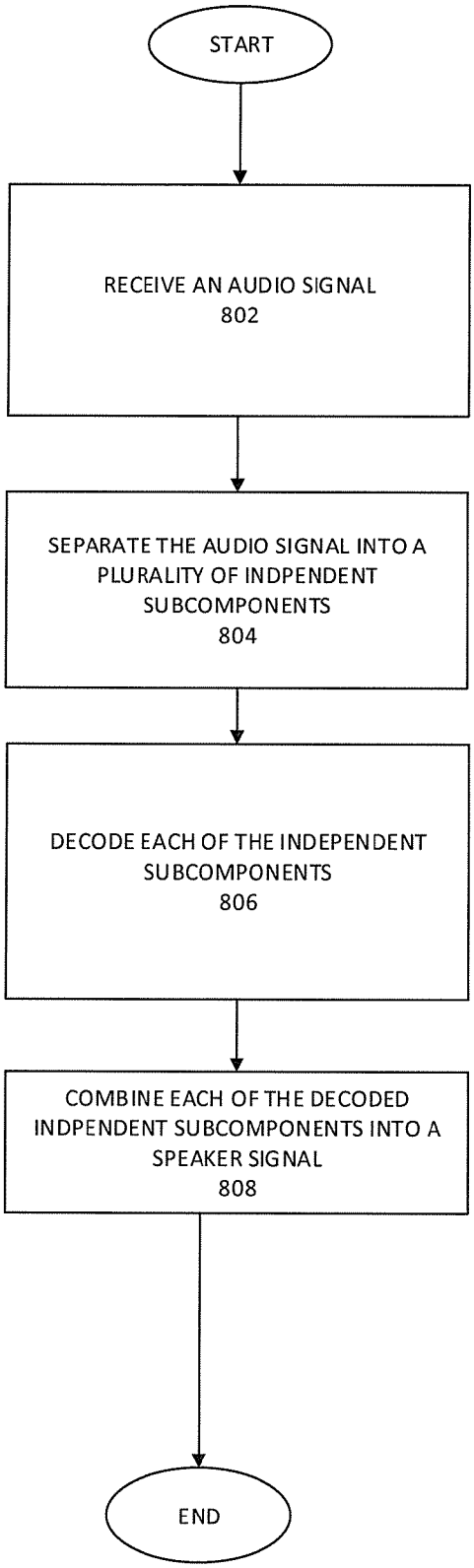
FIG. 8 illustrates a process for managing an audio signal in accordance with an embodiment of this disclosure.

FIG. 8 illustrates a process for managing an audio signal in accordance with an embodiment of this disclosure. A controller here may represent the main processor 240 and a memory element may be the memory 260 in FIG. 2. The embodiment of the process shown in FIG. 8 is for illustration only. Other embodiments of the process could be used without departing from the scope of this disclosure.

At operation 802, the controller receives the audio signal. The audio signal includes a plurality of ambisonic components. The audio signal can be received from a number of devices, such as, but not limited to, a mobile device, the Internet, a compact disc, and the like.

At operation 804, the controller separates the audio signal into a plurality of indpendent ambisonic subcomponents. Each of the indpendent ambisonic subcomponents is from a different source.

At operation 806, the controller decodes each of the indpendent ambisonic subcomponents. At operation 806, the controller combines each of the decoded indpendent ambisonic subcomponents into a speaker signal.

None of the description in this application should be read as implying that any particular element, step, or function is an essential element that must be included in the claim scope. The scope of patented subject matter is defined only by the claims. Moreover, none of the claims is intended to invoke 35 U.S.C. § 112(f) unless the exact words "means for" are followed by a participle.

What is claimed is:

1. An audio receiver, the audio receiver comprising:

a memory configured to store ambisonic audio signals; and processing circuitry coupled to the memory, the processing circuitry configured to:

receive the ambisonic audio signals, the ambisonic audio signals comprising a plurality of ambisonic components;

separate the ambisonic audio signals into a plurality of independent ambisonic subcomponents such that each of the independent ambisonic subcomponents corresponds to a different physical sound source;

decode each of the independent ambisonic subcomponents; and combine each of the decoded independent ambisonic subcomponents into speaker signals.

2. The audio receiver of claim 1, wherein decoding each of the independent ambisonic subcomponents comprises the processing circuitry configured to:

separate and decode each of the plurality of ambisonic components for each of the independent ambisonic subcomponents into a plurality of frames;

overlap each frame with at least one adjacent frame; and perform smoothing on the overlapping frames.

3. The audio receiver of claim 2, wherein a smoothing factor of the smoothing is based on a correlation between overlapping parts of the plurality of frames of the plurality of decoded ambisonic components.

4. The audio receiver of claim 3, wherein the correlation derived by:

$$\rho_m = corr\left\{Sp\left(m, 1:\frac{L}{2}\right), SpOld\left(m, \frac{L}{2}+1:L\right)\right\},$$

where m is the ambisonic audio signals, L is a frame length, Sp is a current frame, SpOld is a previous frame, and $\rho_m$ is the correlation between overlapping parts of the plurality of frames of the plurality of decoded ambisonic components in the current frame and previous frame.

5. The audio receiver of claim 1, wherein the processing circuitry is configured to:

mask a number of signals of the ambisonic audio signals within a threshold.

6. The audio receiver of claim 5, wherein the threshold is set to comprise inaudible parts of the ambisonic audio signals.

7. The audio receiver of claim 1, further comprising:

a transceiver configured to transmit the speaker signals to a plurality of speakers.

8. A method for managing ambisonic audio signals, the method comprising:

receiving the ambisonic audio signals, the ambisonic audio signals comprising a plurality of ambisonic components;

separating the ambisonic audio signals into a plurality of independent ambisonic subcomponents such that each of the independent ambisonic subcomponents corresponds to a different physical sound source;

decoding each of the independent ambisonic subcomponents; and combining each of the decoded independent ambisonic subcomponents into speaker signals.

9. The method of claim 8, wherein decoding each of the independent ambisonic subcomponents comprises:

separating and decoding each of the plurality of ambisonic components for each of the independent ambisonic subcomponents into a plurality of frames;

overlapping each frame with at least one adjacent frame; and performing smoothing on the overlapping frames.

10. The method of claim 9, wherein a smoothing factor of the smoothing is based on a correlation between overlapping parts of the plurality of frames of the plurality of decoded ambisonic components.

11. The method of claim 10, wherein the correlation derived by:

$$\rho_m = corr\left\{Sp\left(m, 1:\frac{L}{2}\right), SpOld\left(m, \frac{L}{2}+1:L\right)\right\},$$

where m is the ambisonic audio signals, L is a frame length, Sp is a current frame, SpOld is a previous frame, and $\rho_m$ is the correlation between overlapping parts of the plurality of frames of the plurality of decoded ambisonic components in the current frame and previous frame.

12. The method of claim 8, further comprising:

masking a number of signals of the ambisonic audio signals within a threshold.

13. The method of claim 12, wherein the threshold is set to comprise inaudible parts of the ambisonic audio signals.

14. The method of claim 8, further comprising:

transmitting the speaker signals to a plurality of speakers.

15. A non-transitory computer readable medium embodying a computer program, the computer program comprising computer readable program code that when executed causes at least one processing device to:

receive ambisonic audio signals, the ambisonic audio signals comprising a plurality of ambisonic components;

separate the ambisonic audio signals into a plurality of independent ambisonic subcomponents such that each of the independent ambisonic subcomponents corresponds to a different physical sound source;

decode each of the independent ambisonic subcomponents; and combine each of the decoded independent ambisonic subcomponents into speaker signals.

16. The non-transitory computer readable medium of claim 15, wherein decoding each of the independent ambisonic subcomponents comprises the computer readable program code that when executed causes at least one processing device to:

separate and decode each of the plurality of ambisonic components for each of the independent ambisonic subcomponents into a plurality of frames;

overlap each frame with at least one adjacent frame; and perform smoothing on the overlapping frames.

17. The non-transitory computer readable medium of claim 16, wherein a smoothing factor of the smoothing is based on a correlation between overlapping parts of the plurality of the plurality of frames of the plurality of decoded ambisonic components.

18. The non-transitory computer readable medium of claim 17, wherein the correlation derived by:

$$\rho_m = corr\left\{Sp\left(m, 1:\frac{L}{2}\right), SpOld\left(m, \frac{L}{2}+1:L\right)\right\},$$

where m is the ambisonic audio signals, L is a frame length, Sp is a current frame, SpOld is a previous frame, and $\rho_m$ is the correlation between overlapping parts of the plurality of frames of the plurality of decoded ambisonic components in the current frame and previous frame.

19. The non-transitory computer readable medium of claim 15, further comprising computer readable program code that when executed causes at least one processing device to:

mask a number of signals of the ambisonic audio signals within a threshold.

20. The non-transitory computer readable medium of claim 19, wherein the threshold is set to comprise inaudible parts of the ambisonic audio signals.

* * * * *